US005363687A

United States Patent [19]

Anthony et al.

[11] Patent Number: 5,363,687

[45] Date of Patent: Nov. 15, 1994

[54] DIAMOND WIRE DIE

[75] Inventors: Thomas R. Anthony, Schenectady, N.Y.; Brad E. Williams, Worthington, Ohio

[73] Assignee: General Electric Company, Worthington, Ohio

[21] Appl. No.: 121,014

[22] Filed: Sep. 14, 1993

[51] Int. Cl.[5] ..... B21D 3/02

[52] U.S. Cl. ..... 72/467; 423/446

[58] Field of Search ..... 72/467; 423/446; 51/307; 156/DIG. 68

[56] References Cited

U.S. PATENT DOCUMENTS 4,412,980 11/1983 Tsuji ..... 51/307
4,707,384 11/1987 Schachner ..... 427/249
4,734,339 3/1988 Schachner ..... 428/701
5,127,983 7/1992 Imai ..... 423/446
5,176,803 1/1993 Barbuto ..... 204/129.1

FOREIGN PATENT DOCUMENTS 3139796 4/1983 Germany ..... 72/467

*Primary Examiner*—Daniel C. Crane

[57] ABSTRACT

A CVD diamond wire drawing die has smaller diamond grains adjacent an initial diamond growth surface with larger diamond grains adjacent an opposing surface with an opening having a wire bearing portion of substantially circular cross-section determinative of the diameter of the wire positioned more closely adjacent to the opposing surface in a region of larger grains than to the initial growth surface.

31 Claims, 1 Drawing Sheet

DIAMOND WIRE DIE

TECHNICAL FIELD OF THE INVENTION

The present invention relates to diamond wire dies.

BACKGROUND OF THE INVENTION

Wires of metals such as tungsten, copper, iron, molybdenum, and stainless steel are produced by drawing the metals through diamond dies. Single crystal diamond dies are difficult to fabricate, tend to chip easily, easily cleave, and often fail catastrophically because of the extreme pressures involved during wire drawing.

With reference to single crystal wire dies, it is reported in Properties and Applications of Diamond, Wilks et al, Butterworth-Heinemann Ltd. 1991, pages 505–507: "The best choice of [crystallographic] direction is not too obvious because as the wire passes through the die its circumference is abrading the diamond on a whole 360° range of planes, and the rates of wear on these planes will be somewhat different. Hence, the originally circular hole will not only grow larger but will loose its shape. However, <110> directions offer the advantage that the wire is abrading the sides of the hole with {001} and {011} orientations in abrasion resistant directions."

Diamond dies which avoid some of the problems attendant with natural diamonds of poorer quality comprise microporous masses compacted from tiny crystals of natural or synthesized diamonds or from crystals of diamond. The deficiencies of such polycrystalline hard masses, as indicated in U.S. Pat. No. 4,016,736, are due to the presence of microvoids/pores and soft inclusions. These voids and inclusions can be more than 10 microns in diameter. The improvement of the patent utilizes a metal cemented carbide jacket as a source of flowable metal which fills the voids resulting in an improved wire die.

European Patent Application 0 494 799 A1 describes a polycrystalline CVD diamond layer having a hole formed therethrough and mounted in a support. As set forth in column 2, lines 26–30, "The relatively random distribution of crystal orientations in the CVD diamond ensures more even wear during use of the insert." As set forth in column 3, lines 50–54, "The orientation of the diamond in the polycrystalline CVD diamond layer 10 may be such that most of the crystallites have a (111) crystallographic axis in the plane, i.e. parallel to the surfaces 14, 16, of the layer 10."

Other crystal orientations for CVD films are known. U.S. Pat. No. 5,110,579 to Anthony et al describes a transparent polycrystalline diamond film as illustrated in FIG. 3A, substantially transparent columns of diamond crystals having a <110> orientation perpendicular to the base.

Because of its high purity and uniform consistency, CVD diamond may be desirably used as compared to the more readily available and poor quality natural diamond. Because CVD diamond can be produced without attendant voids, it is often more desirable than polycrystalline diamond produced by high temperature and high pressure processes. However, further improvements in the structure of CVD wire drawing dies are desirable. Particularly, improvements in grain structure of CVD diamond wire die which tend to enhance wear and uniformity of wear are particularly desirable.

BRIEF SUMMARY OF THE INVENTION

Hence, it is desirable obtain a dense void-free CVD diamond wire die having a structure which provides for enhanced wear and uniformity of wear.

In accordance with the present invention, there is provided a die for drawing wire of a predetermined diameter comprising a CVD diamond body having a first surface in a region of larger diamond grains and a second surface in a region of smaller diamond grains, an opening extending through said body and having a wire bearing portion of substantially circular cross-section determinative of the diameter of the wire positioned more closely adjacent to said first surface in said region of larger grains than to said second surface in a region of smaller diamond grains.

In accordance with a preferred embodiment, a die for drawing wire has an opening extending entirely through the body along an axial direction from one surface to the other in an axial direction with diamond grains having a <110> orientation extending substantially along the axial direction.

In accordance with an additional preferred embodiment wherein the grain orientation is parallel to the axial direction and the wire bearing portion is substantially entirely within a single diamond grain.

DETAILED DESCRIPTION

Figure 1:
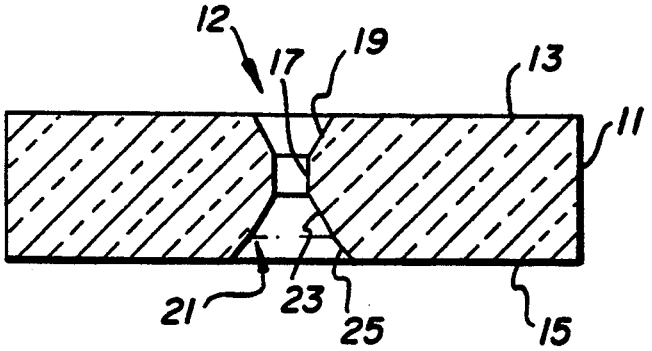
FIG. 1 is a cross-sectional view of a diamond wire die.

FIG. 1 illustrates a diamond wire die 11 produced from a CVD diamond layer. Such dies are typically cut from a CVD diamond layer which has been separated from a growth substrate. This layer may be thinned to a preferred thickness. The major opposing surfaces of the die blank may be planarized and/or thinned to the desired surface finish by mechanical abrasion or by other means such as laser polishing, ion thinning, or other chemical methods. Preferably, conductive CVD diamond layers can be cut by electro-discharge machining, while insulating films can be cut with a laser to form discs, squares, or other symmetrical shapes. When used for wire drawing, the outer periphery of the die 11 is mounted in a support so as to resist axially aligned forces due to wire drawing.

As shown in more detail in FIG. 1, the wire die 11 includes an opening 12 aligned along an axis in a direction normal to spaced apart parallel flat surfaces 13 and 15. For purposes of description, surface 13 is hereinafter referred as the top surface and surface 15 is referred to as the bottom surface 15. The opening 12 is of an appropriate size which is determined by the desired size of the wire. The straight bore section 17 of opening 12 includes has a circular cross section which is determinative of the desired final diameter of the wire to be drawn. From the straight bore section 17, the opening 12 tapers outwardly at exit taper 19 toward the top surface 13 and at entrance taper 21 toward the bottom surface 15. The wire to be drawn initially passes through entrance taper 21 where an initial size reduction occurs prior to passing through the straight bore section 17 and exit taper 19.

The entrance taper 21 extends for a greater distance along the axial direction than exit taper 19. Thus, the straight bore section 17 is closer to top surface 13 than to bottom surface 15. Entrance taper 21 includes a wide taper 25 opening onto the bottom surface 15 and narrow taper 23 extending between the straight bore 17 and the wider taper 25.

The opening 12 may be suitably provided by first piercing a pilot hole with a laser and then utilizing a pin ultrasonically vibrated in conjunction with diamond grit slurry to abrade an opening 12 by techniques known in the art.

Typical wire drawing dies have a disc-shape although square, hexagonal, octagonal, or other polygonal shapes may be used. Preferably, wire dies have a thickness of about 0.4–10 millimeters. The length measurement as in the case of a polygonal shape or the diameter measurement as in the case of a rounded shape, is preferably about 1–20 millimeters. Preferred thicknesses are from 0.3–10 millimeters with preferred lengths being 1–5 millimeters. The opening or hole 12 suitable for drawing wire typically has a diameter from 0.030 mm to 5.0 mm. Wire dies as prepared above, may be used to draw wire having desirable uniform properties. The wire die may contain more than one hole, and these holes may or may not be the same diameter and shape.

A preferred technique for forming the diamond wire die substrate of the present invention is set forth in U.S. Pat. No. 5,110,579 to Anthony et al. According to the processes set forth in the patent, diamond is grown by chemical vapor deposition on a substrate such as molybdenum by a filament process. According to this process, an appropriate mixture such as set forth in the example is passed over a filament for an appropriate length of time to build up the substrate to a desired thickness and create a diamond film. As set forth in the patent, a preferred film is substantially transparent columns of diamond crystals having a <110> orientation perpendicular to the base. Grain boundaries between adjacent diamond crystals having hydrogen atoms saturating dangling carbon bonds is preferred wherein at least 50 percent of the carbon atoms are believed to be tetrahedral bonded based on Raman spectroscopy, infrared and X-ray analysis. It is also contemplated that H, F, Cl, Q or other atoms may saturate dangling carbon atoms.

Figure 3:
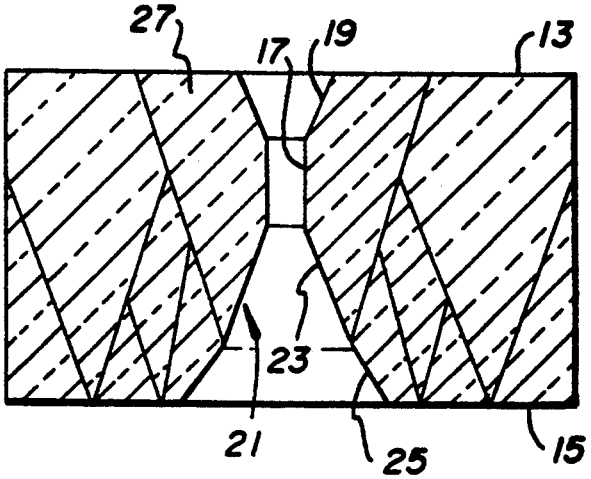
FIG. 3 is a cross-sectional view of the wire die portion shown in FIG. 2.

The view as illustrated in FIG. 3 of the polycrystalline diamond film in cross section further illustrates the substantially transparent columns of diamond crystals having a <110> orientation perpendicular to the bottom surface. The preferred film utilized in the present invention has the properties described above including, grain boundaries between adjacent diamond crystals preferably have hydrogen atoms saturating dangling carbon bonds as illustrated in the patent.

Figure 2:
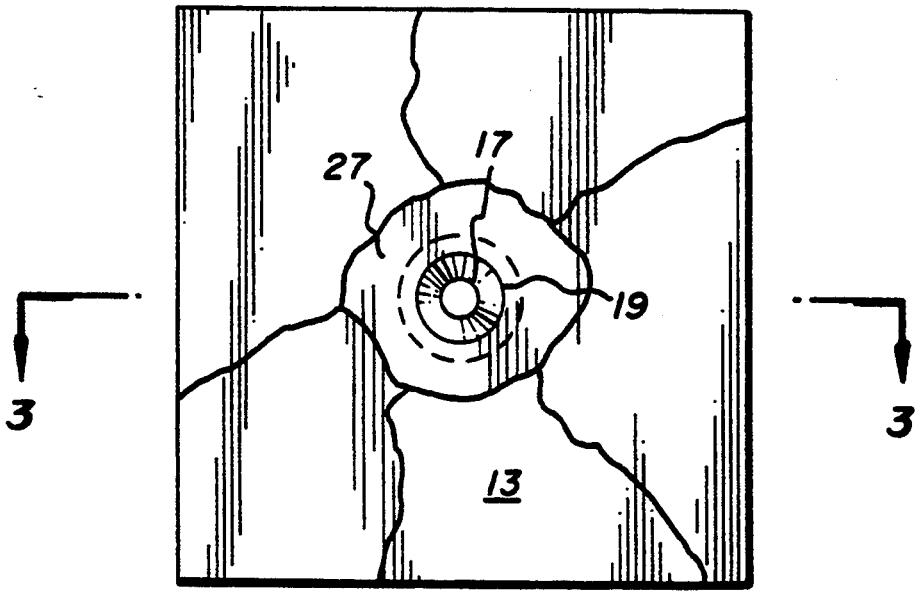
FIG. 2 is an enlarged top-view of a portion of the wire die shown in FIG. 1.

When utilized in the present invention, the diamond film is preferably positioned so that wire die bottom surface 15 corresponds to the initial growth surface that was adjacent the molybdenum substrate during growth of the diamond film and top surface 13 is the surface exposed to the chemical vapor deposition process. This positioning of the wire die results in a micro-graphic structure as illustrated in FIG. 3. The initial vapor deposition of diamond on the substrate results in the seeding of diamond grains or individual diamond crystals. As shown in FIG. 3, as the individual crystals growth in an axial direction, i.e. a direction normal to the top and bottom surfaces, 13 and 15, the cross sectional area as measured along planes parallel to the top and bottom surfaces, 13 and 15, increases. FIG. 2, shows view of the top surface 15 where a portion of the diamond grains are at their maximum width.

In accordance with the preferred embodiment of the present invention, the straight bore section 17 is preferably substantially entirely within a single diamond grain. As illustrated in FIG. 3, the straight bore is positioned interior to diamond grain 27. The <110> preferred grain direction is preferably perpendicular to the major plane of the film and a randomly aligned grain direction about the <110>.

A preferred process for making the film is the filament process as above described. Additional preferred properties of the diamond film include a thermal conductivity greater than about 4 watts/cm-K. The film is preferably non-opaque or transparent or translucent and contains hydrogen and oxygen greater than about I part per million. The diamond film preferably contains less than one part per million of catalyst material, such as iron, nickel, or cobalt. The film may contain greater than 10 parts per billion and less than 10 parts per million of Si, Ge, Nb, V, Ta, Mo, W, Ti, Zr or Hf. Preferably the film may also contain more than one part per million of a halogen, i.e. fluorine, chlorine, Bromine, or iodine. Additional additives may include N, B, O, and P which may be present in the form of interntial additives. It's anticipated that films that can be utilized in the present invention may be made by other processes, such as by microwave diamond forming processes.

It is contemplated that CVD diamond having such preferred conductivity may be produced by other techniques such as microwave CVD and DC jet CVD. Although, preferably the resulting CVD diamond film may has N, S, Ge, Al, and P, each at levels less than 100 ppm, it is contemplated that suitable films may be produced at greater levels.

It is preferred that the straight bore section 17 be located in a single diamond grain 27 to the extent that the major wear surface of the bore is in the large-grain region of the film which is next to the final growth surface of the film. Most preferably the straight bore section is located entirely within diamond grain 27. It is most preferred to position substantially the entire opening 12 within a single grain or crystal.

We claim:

1. A die for drawing wire of a predetermined diameter comprising a CVD diamond body having a first surface in a region of larger diamond grains and a second surface in a region of smaller diamond grains, an opening extending through said body and having a wire bearing portion of substantially circular cross-section determinative of the diameter of the wire positioned more closely adjacent to said first surface in said region of larger grains than to said second surface in a region of smaller diamond grains.

2. A die for drawing wire in accordance with claim 1 wherein said second surface corresponds to an initially diamond growth surface.

3. A die for drawing wire in accordance with claim 1 wherein said opening extends entirely through said body along an axial direction from said second surface to said first surface, said body including diamond grains having a <110> orientation extending substantially along the axial direction.

4. A die for drawing wire in accordance with claim 3 wherein said wire bearing portion comprises a straight bore section having a circular cross section.

5. A die for drawing wire in accordance with claim 3 wherein said opening tapers outwardly in one direction from said straight bore section toward said first surface and tapers outwardly in the opposite direction toward said second surfaces.

6. A die for drawing wire in accordance with claim 5 wherein said outward taper in said one direction forms a exit taper for the wire and said outward taper in the other direction toward said second surface forms an entrance taper.

7. A die for drawing wire in accordance with claim 6 wherein said entrance taper extends for a greater distance along the axial direction than exit taper.

8. A die for drawing wire in accordance with claim 5 wherein said body has a thickness as measured from one surface to the other surface of about 0.3–10 millimeters.

9. A die for drawing wire in accordance with claim 5 wherein said diamond is grown by chemical vapor deposition on a substrate by a filament process. Selected from the group consisting of Si, Ge, Mo, Hb, V, Ta, W, Ti, Zr or Hf or alloys thereof.

10. A die for drawing wire in accordance with claim 5 wherein said diamond comprises a film of substantially transparent columns of diamond crystals having a <110> orientation perpendicular to the second surface.

11. A die for drawing wire in accordance with claim 5 wherein said diamond said opposing surfaces have been planarized by mechanical lapping and/or chemical, laser, or ion finishing to the desired surface finish.

12. A die for drawing wire in accordance with claim 1 wherein said diamond body comprises a plurality of diamond grains and said wire bearing portion is substantially entirely within a single diamond grain.

13. A die for drawing wire in accordance with claim 12 wherein said second surface corresponds to an initially diamond growth surface.

14. A die for drawing wire in accordance with claim 13 wherein said opening extends entirely through said body along an axial direction from said second surface to said first surface, said body including diamond grains having a <110> orientation extending substantially along the axial direction.

15. A die for drawing wire in accordance with claim 14 wherein said wire bearing portion comprises a straight bore section having a circular cross section.

16. A die for drawing wire in accordance with claim 15 wherein said opening tapers outwardly in one direction from said straight bore section toward said first surface and tapers outwardly in the opposite direction toward said second surfaces.

17. A die for drawing wire in accordance with claim 16 wherein said outward taper in said one direction forms a exit taper for the wire and said outward taper in the other direction toward said second surface forms an entrance taper.

18. A die for drawing wire in accordance with claim 1 wherein process for making the film is made by passing a mixture of gases over a filament for an appropriate length of time to build up the thickness of said substrate to a desired thickness.

19. A die for drawing wire in accordance with claim 1 wherein said body has a thermal conductivity greater than about 4 watts/cm-K.

20. A die for drawing wire in accordance with claim 1 wherein said body non-opaque and contains hydrogen and oxygen greater than about 1 part per million.

21. A die for drawing wire in accordance with claim 1 wherein said body preferably contains less than one part per million of catalyst material, such as iron, nickel, or cobalt.

22. A die for drawing wire in accordance with claim 1 wherein said body contains greater than 10 parts per billion and less than 10 parts per million of Nb, V, Ta, Mo, W, Ti, Zr or Hf.

23. A die for drawing wire in accordance with claim 1 wherein said body comprises more than one part per million of a halogen, i.e. fluorine, chlorine, bromine, or iodine.

24. A die in accordance with claim 1 which has a plurality of holes, which may or may not be the same size and shape.

25. A die in accordance with claim 1 wherein the diamond body or any part thereof is mounted in or attached to a fixture which is suitable for the support of the die.

26. A die in accordance with claim 1 wherein the diamond has an electrical resistivity less than 1000 ohms per centimeter at room temperature.

27. A die in accordance with claim 1 wherein the diamond has an electrical resistivity greater than 1,000,000 ohms per centimeter at room temperature.

28. A die in accordance with claim 1 which has no voids greater than 10 microns in diameter, or inclusions of another material or carbon phase.

29. A die in accordance with claim 1 which has a thermal conductivity of more than 4 watts per centimeter-Kelvin.

30. A die in accordance with claim 1 formed from a diamond layer deposited by microwave, plasma, flame or dc jet process.

31. A die in accordance with claim 1 having saturated dangling carbon atoms.

* * * * *